US008789264B2

(12) United States Patent
Morishita et al.

(10) Patent No.: US 8,789,264 B2
(45) Date of Patent: Jul. 29, 2014

(54) MANUFACTURING APPARATUS FOR HEAT EXCHANGER FINS

(75) Inventors: Keiichi Morishita, Tokyo (JP); Toshiyuki Nanaarashi, Tokyo (JP)

(73) Assignee: Hidaka Seiki Kabushiki Kaisha, Tokyo (JP)

( * ) Notice: Subject to any disclaimer, the term of this patent is extended or adjusted under 35 U.S.C. 154(b) by 323 days.

(21) Appl. No.: 13/447,958

(22) Filed: Apr. 16, 2012

(65) Prior Publication Data

US 2012/0272493 A1 Nov. 1, 2012

(30) Foreign Application Priority Data

Apr. 28, 2011 (JP) ..... 2011-102228

(51) Int. Cl.
*B21D 43/04* (2006.01)

(52) U.S. Cl.
USPC ..... 29/727; 29/33 Q; 29/33 S; 29/563

(58) Field of Classification Search
USPC ..... 29/726, 727, 561, 563, 33 S, 33 Q, 33 P, 29/819; 414/793, 793.1, 792.7
See application file for complete search history.

(56) References Cited

U.S. PATENT DOCUMENTS 4,407,064 A * 10/1983 Denner et al. ..... 29/726
5,349,841 A * 9/1994 Honma et al. ..... 72/333

FOREIGN PATENT DOCUMENTS

JP 05192728 A * 8/1993 ..... B21D 53/08
JP 07-061707 A 3/1995
JP 10-328767 A 12/1998
JP 2003320433 A * 11/2003 ..... B21D 53/08
JP 3881991 B2 2/2007

* cited by examiner

*Primary Examiner* — David Bryant
*Assistant Examiner* — Jason L Vaughan
(74) *Attorney, Agent, or Firm* — Birch, Stewart, Kolasch & Birch, LLP

(57) ABSTRACT

A feeding apparatus for feeding metal strips in a feeding direction includes a plurality of reciprocating members on which feed pins inserted inside through-holes of the metal strips are provided and a driving means that converts up-down movement of a press apparatus to reciprocal movement in the feeding direction to reciprocally move the reciprocating members. In a predetermined half cycle of an up-down movement of the press apparatus, the driving means moves first reciprocating members in the feeding direction in a state where the feed pins have been inserted into the through-holes and returns other reciprocating members in the opposite direction in a state where the feed pins have been lowered, and in the remaining half cycle, the driving means raises and lowers the feed pins of the reciprocating members.

4 Claims, 14 Drawing Sheets

MANUFACTURING APPARATUS FOR HEAT EXCHANGER FINS

CROSS-REFERENCE TO RELATED APPLICATION(S)

This application is based upon and claims the benefit of priority of the prior Japanese Patent Application No. 2011-102228, filed on 28 Apr. 2011, the entire contents of which are incorporated herein by reference.

FIELD

The present invention relates to a manufacturing apparatus for fins used in a heat exchanger.

BACKGROUND

A heat exchanger, such as an air conditioner, is constructed by stacking a plurality of heat exchanger fins, in which a plurality of through-holes have been formed to enable heat exchanger tubes to be inserted. Such heat exchanger fins are manufactured by a manufacturing apparatus for heat exchanger fins depicted in FIG. 8. This manufacturing apparatus for heat exchanger fins is equipped with an uncoiler 12 where a thin metal plate (metal strip) 10 made of aluminum or the like has been wound into a coil. The metal strip 10 pulled out from the uncoiler 12 via pinch rollers 14 is inserted into an oil applying apparatus 16 where machining oil is applied onto the surface of the metal strip 10, and is then supplied to a mold apparatus 20 provided inside a press apparatus 18.

The mold apparatus 20 internally includes an upper mold die set 22 that is capable of up-down movement and a lower mold die set 24 that is static. In the metal strip 10 that has passed through the mold apparatus 20, a plurality of collar-equipped through-holes 11 (also referred to simply as "through-holes" in the present specification), where collars of a predetermined height are formed around through-holes, are formed at predetermined intervals in a predetermined direction. After being conveyed a predetermined distance in the predetermined direction, the metal strip 10 is cut into predetermined lengths by a cutter 26 and then stored in a stacker 28.

The press apparatus 18 is provided with a feeding apparatus that intermittently conveys the metal strip 10, in which a plurality of through-holes 11 have been formed at predetermined intervals in a predetermined direction, toward the cutter 26. FIGS. 9 and 10 are diagrams useful in explaining the conveyance of the metal strip 10 by the operation of the feeding apparatus. The feeding apparatus causes feed pins 68 to advance from below into through-holes 11 formed in the metal strip 10 and conveys the metal strip 10 in the feeding direction by moving the feed pins 68 in the feeding direction. The metal strip 10 is placed on a reference plate 64. A slit 66 formed in a range in which the feed pins 68 move is formed in the reference plate 64. The feed pins 68 protrude upwards from the slit 66.

The feed pins 68 are provided so as to protrude upward on a pin block 56 that is capable of moving in a horizontal direction and an up-down direction. When conveying the metal strip 10 in the conveying direction, the pin block 56 is raised and the feed pins 68 advance into the through-holes 11 of the metal strip 10 placed on the reference plate 64. The pin block 56 then moves in the conveying direction. After the metal strip 10 has been moved to a predetermined position, the pin block 56 is lowered and the feed pins 68 are withdrawn downwards from the through-holes 11. After this, the pin block 56 then moves in the opposite direction to the conveying direction (i.e., in a return direction) while remaining in a state where the feed pins 68 do not contact the metal strip 10 to return to an initial position.

Next, the specific construction of an existing feeding apparatus and the operation thereof will be described with reference to FIGS. 11 to 13. The feeding apparatus includes a reciprocating member 50 that moves reciprocally in the feeding direction and a moving block 54 that is provided above the reciprocating member 50. The moving block 54 is fixed to a shaft 60, which spans between two fixed members 82*a*, 82*b* that are fixed facing one another near both ends of the reciprocating member 50, so as to be capable of moving in the same direction as the direction of movement of the reciprocating member 50. For this reason, the moving block 54 is capable of moving together with the shaft 60 in the direction of movement of the reciprocating member 50.

The pin block 56 that support the feed pins 68 is provided above the moving block 54 and has two plates 56*a*, 56*b* disposed in that order in the up-down direction. A plurality of the feed pins 68 are attached to the pin block 56 so as to be sandwiched between the plates 56*a*, 56*b*. The pin block 56 is energized downwardly (i.e., toward the moving block 54) by an energizing means such as a spring, not depicted). The pin block 56 is therefore capable of moving together with the moving block 54 and when a force that acts upwardly against the energizing force of the energizing means acts upon the pin block 56, the pin block is raised toward the reference plate 64.

An up-down cam portion 80 is provided between the moving block 54 and the pin block 56. The up-down cam portion 80 is composed of an upper cam portion 76 fixed to the pin block 56 and a lower cam portion 78 provided on the moving block 54. Concave and convex portions are formed on the facing surfaces of the upper cam portion 76 and the lower cam portion 78. The lower cam portion 78 is formed on an upper surface of a wide member 78*a* that is placed on the moving block 54 positioned between the fixed members 82*a*, 82*b* and is wider than the moving block 54. The wide member 78*a* is formed with a suitable size so as to protrude beyond the moving block 54 and the pin block 56 toward both ends in the conveying direction.

The concave and convex portions of the upper cam portion 76 are formed on a surface that faces the lower cam portion 78 of the wide member 78*a*. The wide member 78*a* is capable of sliding on the moving block 54, with such movement being restricted by the fixed members 82*a*, 82*b*. That is, when the wide member 78*a* slides in the conveying direction of the metal strip 10, the conveying direction-side end of the wide member 78*a* will hit the inner wall surface of the fixed member 82*b* and when the wide member 78*a* slides in the opposite direction to the conveying direction, the opposite direction-side end of the wide member 78*a* will hit the inner wall surface of the fixed member 82*a*.

As depicted in FIG. 13, when the conveying direction-side end of the wide member 78*a* hits the fixed member 82*b*, the convex portions formed on the upper cam portion 76 and the lower cam portion 78 contact one another. For this reason, the pin block 56 is pressed upward against the energizing force of the energizing means and front end portions of the feed pins 68, 68, . . . provided on the pin block 56 advance inside the through-holes 11 of the metal strip 10 placed on the reference plate 64.

On the other hand, as depicted in FIG. 11 and FIG. 12, when the wide member 78*a* slides in the conveying direction (i.e., toward the fixed member 82*b*) and the other end of the wide member 78*a* hits the fixed member 82*b*, the concave portions and the convex portions formed on the upper cam portion 76 and the lower cam portion 78 fit together. For this reason, the pin block 56 is pressed against the moving block 54 by the energizing force of the energizing means and the front end portions of the feed pins 68, 68, . . . of the pin block 56 are withdrawn downward from the through-holes 11 of the metal strip 10 placed on the reference plate 64.

In such a feeding apparatus for the metal strip 10, the metal strip 10 placed on the reference plate 64 is conveyed in the direction of a fixed block 52*b*, with a positioning pin 84 for positioning the metal strip 10 at such position after conveyance also being provided. Such positioning pin 84 is provided so as to be capable of retractably protruding upward from the fixed block 52*b*. The positioning pin 84 is moved up and down by a positioning cam unit 86 provided on the fixed block 52*b*.

The positioning cam unit 86 is constructed of an upper cam unit 86*a* and a lower cam unit 86*b* where concave and convex portions are formed on facing surfaces, with the lower cam unit 86*b* being formed on a wide member 87 formed so as to be slidable and wider than the fixed block 52*b*. When the lower cam unit 86*b* slides in the direction where the convex portions contact one another, the front end portion of the positioning pin 84 protrudes above the reference plate 64 and is inserted into a through-hole 11 of the metal strip 10 placed on the reference plate 64 to position the metal strip 10.

On the other hand, when the lower cam unit 86*b* slides in the direction where the convex portions and the concave portions of both sides fit together, the front end portion of the positioning pin 84 becomes positioned below the reference surface of the reference plate 64 and is withdrawn from the collar-equipped through-hole 11 of the metal strip 10 placed on the reference plate 64 to release the positioning of the metal strip 10.

The wide member 87 of the lower cam unit 86*b* is linked by a shaft 90 to a slide member 88 that is slidably inserted into the fixed block 52*a* that faces the fixed block 52*b*. The shaft 90 is disposed so as to span between the two fixed blocks 52*a*, 52*b* disposed facing one another along the conveying direction. The shaft 90 is disposed so as to pass through the reciprocating member 50 and is provided so as to not obstruct movement of the reciprocating member 50.

When the reciprocating member 50 has moved in the conveying direction, the conveying direction-side end of the reciprocating member 50 will press an end portion of the wide member 87 of the lower cam unit 86*b* and thereby cause the lower cam unit 86*b* to slide in a direction where the convex portions contact the convex portions of the upper cam unit 86*a*. Conversely, when the reciprocating member 50 has moved in the opposite direction to the conveying direction, the end portion on the opposite side of the reciprocating member 50 to the conveying direction will press an end portion of the slide portion 88 provided at the opposite side of the shaft 90 to the wide member 87 and thereby cause the lower cam unit 86*b* to slide in a direction where the concave portions and convex portions of the upper cam unit 86*a* and the lower cam unit 86*b* fit together.

Next, a movement operation of the moving block will be described with reference to FIGS. 14 and 15. The moving block 54 is held in the center of the reciprocating member 50 by springs, not depicted. A holding means 92 that holds the moving block 54 reliably at a predetermined position on the reciprocating member 50 is provided on the reciprocating member 50 so as to protrude from the reciprocating member 50. The holding means 92 includes a pin member 98 whose front end portion protrudes from the reciprocating member 50 toward the moving block 54 and engages the moving block 54. The pin member 98 is constructed so as to be capable of holding and releasing the moving block 54 in accordance with movement of the reciprocating member 50. A wheel 97 that rotates along the conveying direction is provided at the lower end portion of the pin member 98 and is constantly energized downward by an energizing means 95.

A cam member 96 with a trapezoidal portion that projects upward is disposed below the reciprocating member 50. A lower end portion of the pin member 98 where the wheel 97 is provided contacts the surface of the cam member 96 due to the energizing force of the energizing means 95.

When the wheel 97 is positioned on the trapezoidal portion of the cam member 96, the front end portion of the pin member 98 is raised and becomes inserted in a concave portion of the moving block 54, thereby engaging the moving block 54. The holding means 92 is thereafter capable of reliably holding the moving block 54 at a predetermined position on the reciprocating member 50. On the other hand, when the moving block 54 has moved and approached the final end, the wheel 97 is located at a lower position than the trapezoidal portion of the cam member 96, the front end portion of the pin member 98 becomes withdrawn from the concave portion of the moving block 54, and the engagement of the pin member 98 and the moving block 54 is released.

Note that the reciprocal movement of the reciprocating member 50 is carried out by a pressing operation of a press apparatus. A driving means for reciprocally moving the reciprocating member by way of a pressing operation of the press apparatus is depicted in FIG. 16. In this driving means, a linking shaft 32 is linked to an eccentric pin of a crank 30 that rotates in synchronization with the press apparatus 18, and a first link 36 that swings about a pin 34 and a second link 42 that is linked to a lever 40 that rotates about a fulcrum shaft 38 are linked to a pin 44 at the lower end of the linking shaft 32. A cylinder apparatus 37 is provided on the first link 36 to adjust the swing angle thereof. In this way, by rotating the crank 30 in synchronization with the press apparatus 18, the linking shaft 32 causes the lever 40 to move reciprocally via the first link 36 and the second link 42. The lever 40 is connected to the reciprocating member 50 and the reciprocating member 50 moves reciprocally based on the reciprocal movement of the lever 40.

Patent Document 1

Japanese Patent No. 3,881,991

SUMMARY

An up-down operation of the press apparatus is depicted as a rotational operation in FIG. 17 and by an operation chart in FIG. 18. When the crank 30 has made one revolution (i.e., rotated by 360°) based on one up-down cycle where in the press apparatus, the mold changes from being open, to being closed and then to being open again, the 0° position is the upper dead point and the 180° position is the lower dead point. The movement of the reciprocating member 50 in such up-down cycle of the press apparatus is movement in the feeding direction between 270° to 0° (upper dead point) to 90° for the crank 30 and is movement in the opposite direction to the feeding direction (that is, the return direction) between 90° to 180° (lower dead point) to 270° for the crank 30.

That is, with the existing technology, the reciprocal movement of the reciprocating member 50 is completed in one revolution of the crank 30, and during such single revolution, a raising operation and lowering operation of the feed pins 68 and a raising operation and a lowering operation of the positioning pin 84 are also carried out. Since the lowering of the feed pins 68 and the raising of the positioning pin 84 are carried out when the feeding of the metal strip has been completed (that is, before movement of the reciprocating member 50 in the feeding direction ends), the feed pins 68 are lowered and the positioning pin 84 is raised at a position before the crank 30 reaches 90° in FIG. 17. Since the raising of the feed pins 68 and the lowering of the positioning pin 84 are carried out immediately before the start of feeding of the metal strip (that is, immediately before the start of movement of the reciprocating member 50 in the feeding direction), the feed pins 68 are raised and the positioning pin 84 is lowered at a position before the crank 30 reaches 270° in FIG. 17.

With this existing technology, reciprocal movement of the reciprocating member and up-down movement of the feed pins are carried out during one up-down cycle of the press apparatus. This means that the time assigned to the conveyance of the metal strip by the reciprocal moving member which excludes the time when the feed pins are moved up and down is short, making it conventionally necessary to increase the speed of conveyance of the metal strip due to the movement of the reciprocating member. When the conveying speed of the metal strip is increased, the acceleration of the metal strip from the stopped state to the start of conveyance is high (sudden acceleration) and the deceleration from the conveyed state to the stopped state is also high (sudden deceleration). When the metal strip is conveyed in this way with sudden acceleration and sudden deceleration, there is the problem of an extremely large load being applied to the metal strip. In recent years in particular, metal strips have become extremely thin, so that the application of a large load carries the risk of deformation or the like of products. Conveyance that involves sudden acceleration and sudden deceleration has a further problem in that the feeding precision of the metal strip is poor.

The present invention was conceived to solve the problem described above and aims to provide a manufacturing apparatus for heat exchanger fins that is capable of conveying metal strips, in which through-holes have been formed by press machining, without sudden acceleration and sudden deceleration.

According to an aspect of the present invention, there is provided a manufacturing apparatus for heat exchanger fins including: a press apparatus that forms metal strips by aligning a plurality of thin metal plates in a feeding direction of the metal plates and in a width direction that is a direction perpendicular to the feeding direction and forming, by press machining, a plurality of through-holes; and a feeding apparatus that feeds the metal strips formed by the press apparatus in the feeding direction, wherein the feeding apparatus includes: a reference plate on whose upper surface the metal strips are placed and in which a slit that extends in the feeding direction of the metal strips is formed so as to pass through from the upper surface to a lower surface of the reference plate; a plurality of reciprocating members that are provided below the reference plate, move reciprocally in parallel to the reference plate in the feeding direction of the metal strips and an opposite direction, and are provided with feed pins, which are capable of up-down movement toward the reference plate and whose front end portions are inserted into the through-holes of the metal plates placed on the reference plate; and driving means that converts up-down movement of the press apparatus to reciprocal movement in the feeding direction and the opposite direction and causes the reciprocating members to move reciprocally, wherein the plurality of reciprocating members are split into two groups that move reciprocally with respectively different orders, and wherein in a predetermined half cycle out of one cycle of the up-down movement of the press apparatus, the driving means drives the groups of the reciprocating members so that a first reciprocating member group out of the two reciprocating member groups carries out a feeding process where the first reciprocating member group moves in the feeding direction with the feed pins inserted inside the through-holes of the metal strips and a second reciprocating member group out of the two reciprocating member groups carries out a return process where the second reciprocating member group returns in the opposite direction to the feeding direction in a state were the feed pins are lowered, and in a remaining half cycle, the driving means carries out a lowering process for the feed pins of the first reciprocating member group and a raising process for the feed pins of the second reciprocating member group but does not drive the reciprocating member groups in the feeding direction or the opposite direction.

By using this construction, in the feeding apparatus, the conveyance of metal strips is carried out using the reciprocating members in one half cycle of an up-down movement of the press apparatus and the raising and lowering of feed pins is carried out in the remaining half cycle. This means that compared to existing technology where the conveyance of the metal strips by reciprocating members and the lowering of the feed pins are carried out in one half cycle of an up-down movement of the press apparatus and where a return operation of the reciprocating members and a raising of the feed pins are carried out in the remaining half cycle, it is possible to increase the time spent on conveying the metal strips, which makes it possible to avoid sudden acceleration and sudden deceleration when conveying the metal strips and to also reduce the load applied to the metal strips.

In addition, the driving means may include: a link portion that converts the up-down movement of the press apparatus to reciprocal movement in the feeding direction and the opposite direction; a rack that is moved reciprocally by the link portion; a gear mechanism that meshes the rack and converts reciprocal movement of the rack to rotational movement; a clutch mechanism that is provided inside the gear mechanism and converts only movement in one direction out of the reciprocal movement of the rack to rotational movement in one direction; a plurality of final output gears that are aligned and mesh one another in the width direction so as to finally output from the gear mechanism to the plurality of reciprocating members; and a plurality of link arms that link the final output gears and the respective reciprocating members to convert the rotational movement of the final output gears to reciprocal movement of the respective reciprocating members. With this construction, firstly, it is possible with the clutch mechanism to not transmit the movement in one half cycle of an up-down movement of the press apparatus to the final output gears. This means that it is possible to use the period where the movement is not transmitted to the final output gears as a period used for an up-down movement of the feed pins with no reciprocal movement of the reciprocating members. Also, since a plurality of final output gears are aligned so as to mesh one another, adjacent final output gears will rotate in respectively different directions. Accordingly, the movement of the link arms linked to adjacent final output gears will be in respectively different directions, which makes it possible to use the reciprocating members linked to adjacent final output gears as the reciprocating members that compose the first reciprocating member group and the reciprocating members that compose the second reciprocating member group.

Up-down movement means, which move the feed pins of the respective reciprocating members up and down, may be provided separately to the driving means that operates based on a pressing operation of the pressing apparatus. With this construction, since it is not necessary for the feed pins to operate based on an operation of the press apparatus, it is possible to provide sufficient time to convey the metal strips.

According to the present invention, it is possible to reliably convey metal strips without sudden acceleration or sudden deceleration. This means that an excessive load is not applied to the metal strips being conveyed and the conveying precision can also be raised.

DESCRIPTION OF EMBODIMENT(S)

Figure 8:
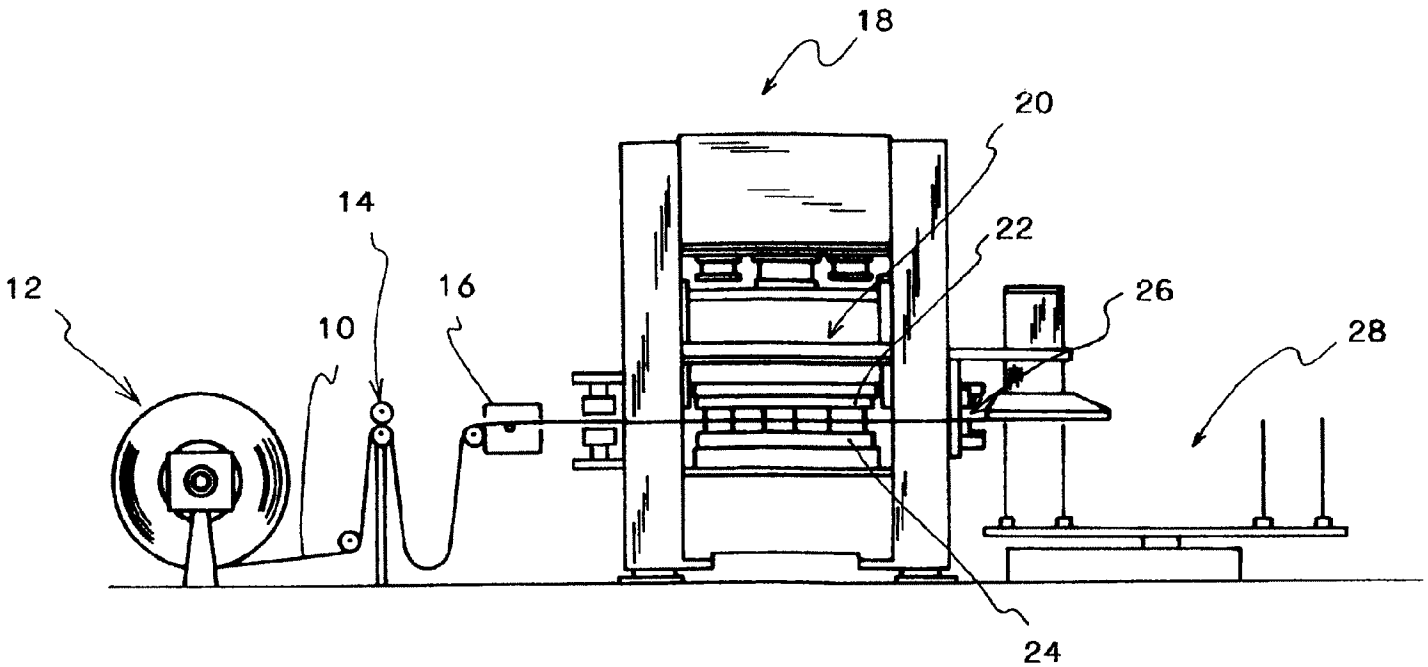
FIG.8 PRIOR ART
FIG. 8 is a diagram useful in explaining the overall construction of a heat exchanger fin manufacturing apparatus.
Figure 9:
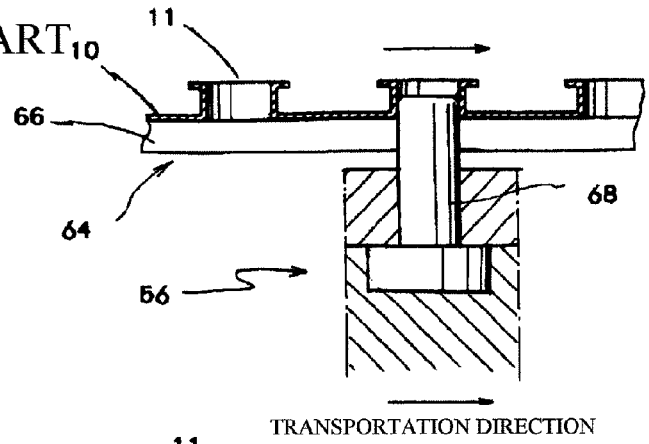
FIG.9 PRIOR ART
FIG. 9 is a diagram useful in explaining a state where a metal strip is being conveyed by a feed pin.
Figure 10:
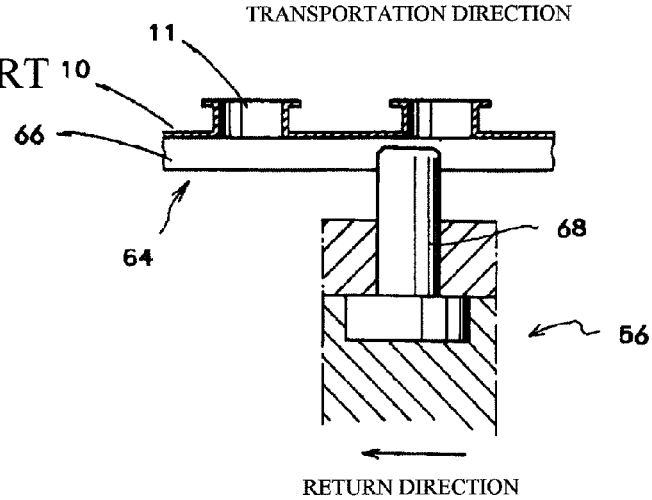
FIG.10 PRIOR ART
FIG. 10 is a diagram useful in explaining a state where the feed pin returns to an initial position after conveying the metal strip.
Figure 11:
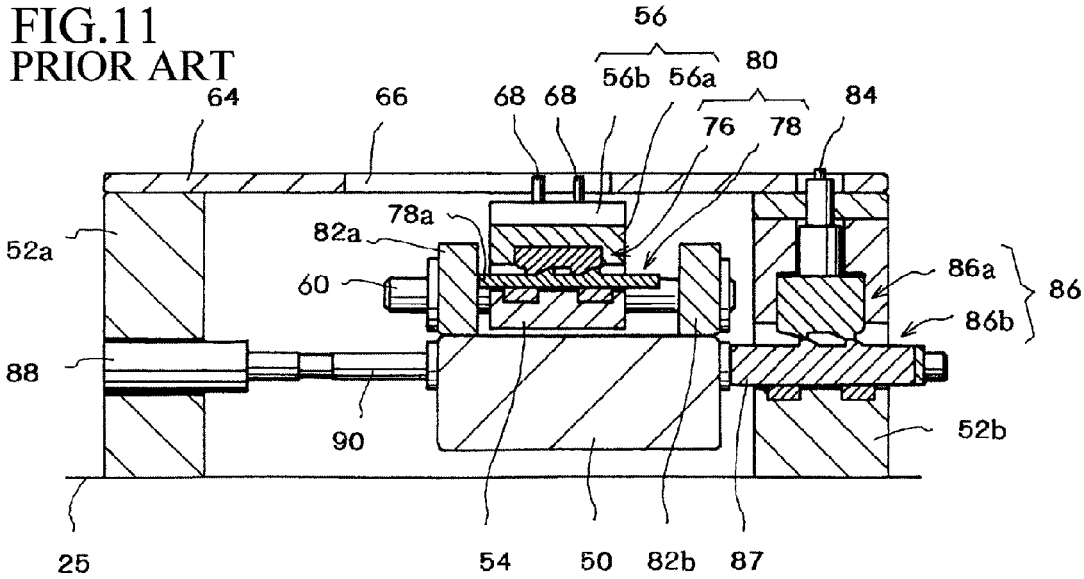
FIG.11 PRIOR ART
FIG. 11 is a diagram useful in explaining, for a construction for raising and lowering the pin block, a state where a moving block has reached a final position and feed pins have been lowered.
Figure 12:
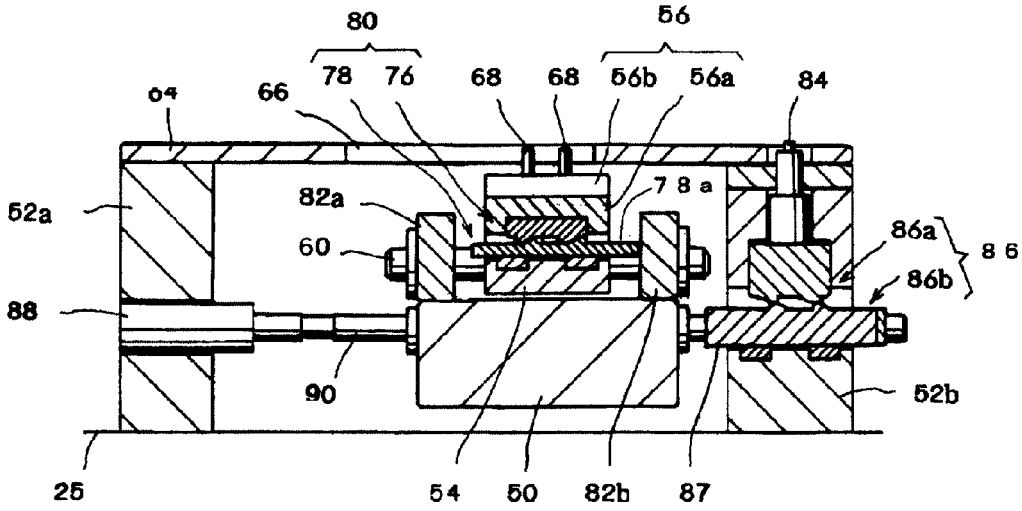
FIG.12 PRIOR ART
FIG. 12 is a diagram useful in explaining a state where the moving block is about to return toward an initial position.
Figure 13:
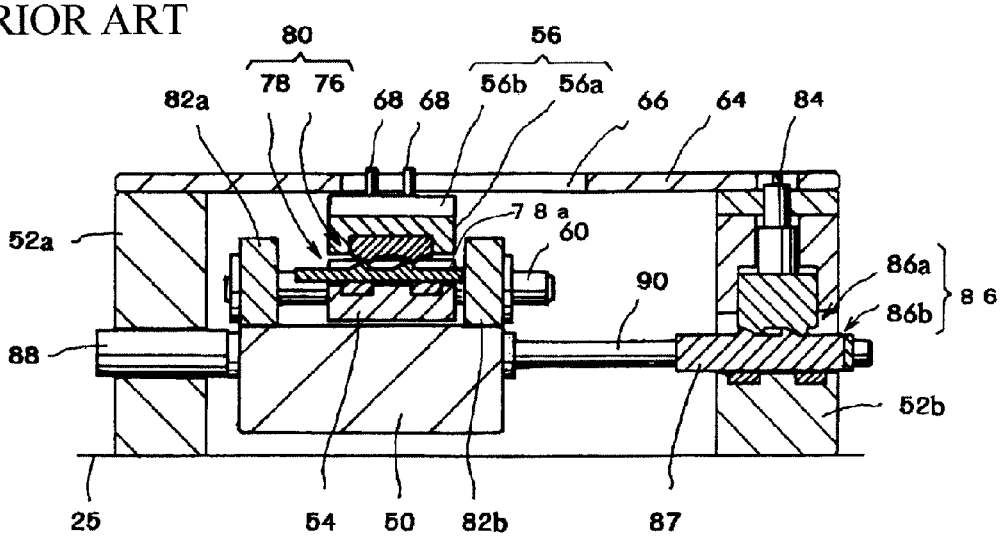
FIG.13 PRIOR ART
FIG. 13 is a diagram useful in explaining a state where the moving block has returned to the initial position in FIG. 12.
Figure 14:
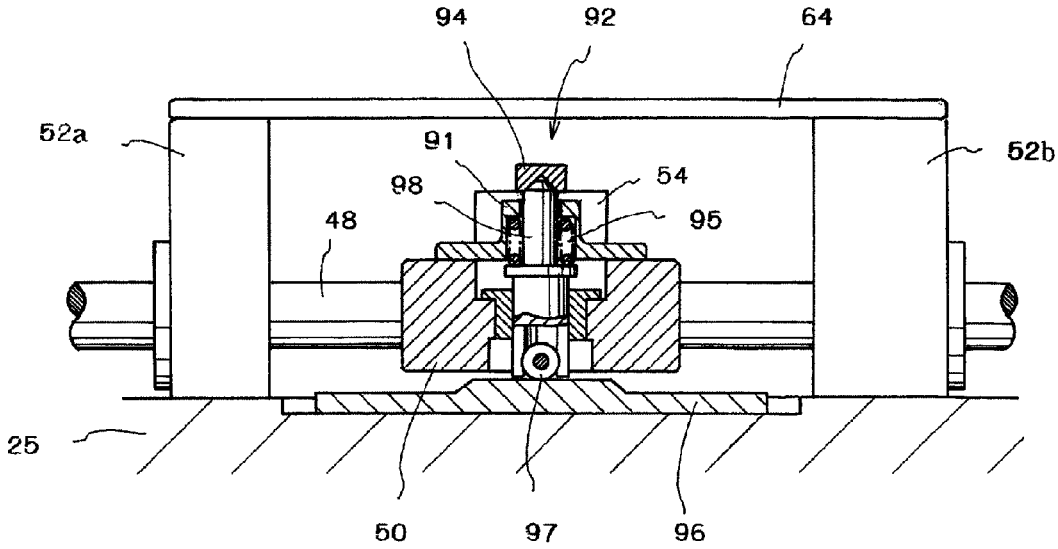
FIG.14 PRIOR ART
FIG. 14 is a diagram useful in depicting the construction of an existing reciprocating member.
Figure 15:
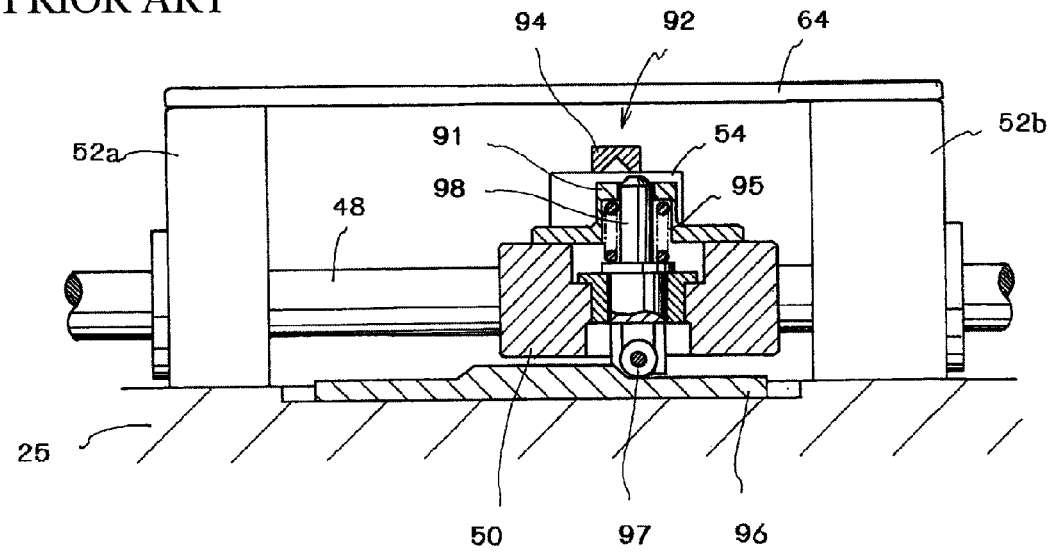
FIG.15 PRIOR ART
FIG. 15 is a diagram useful in depicting a state where engagement of the reciprocating member and the moving block in FIG. 14 has been released.

FIG. 8 depicts the overall configuration of a manufacturing apparatus for heat exchanger fins according to the present invention. Since the overall construction of a manufacturing apparatus for heat exchanger fins has been described for the background art, description thereof is omitted here. Instead, the construction of a preferred embodiment of a feeding apparatus will mainly be described below, the same reference numerals are assigned to the same component elements as described in the background art and description thereof is omitted.

First Embodiment

Figure 1:
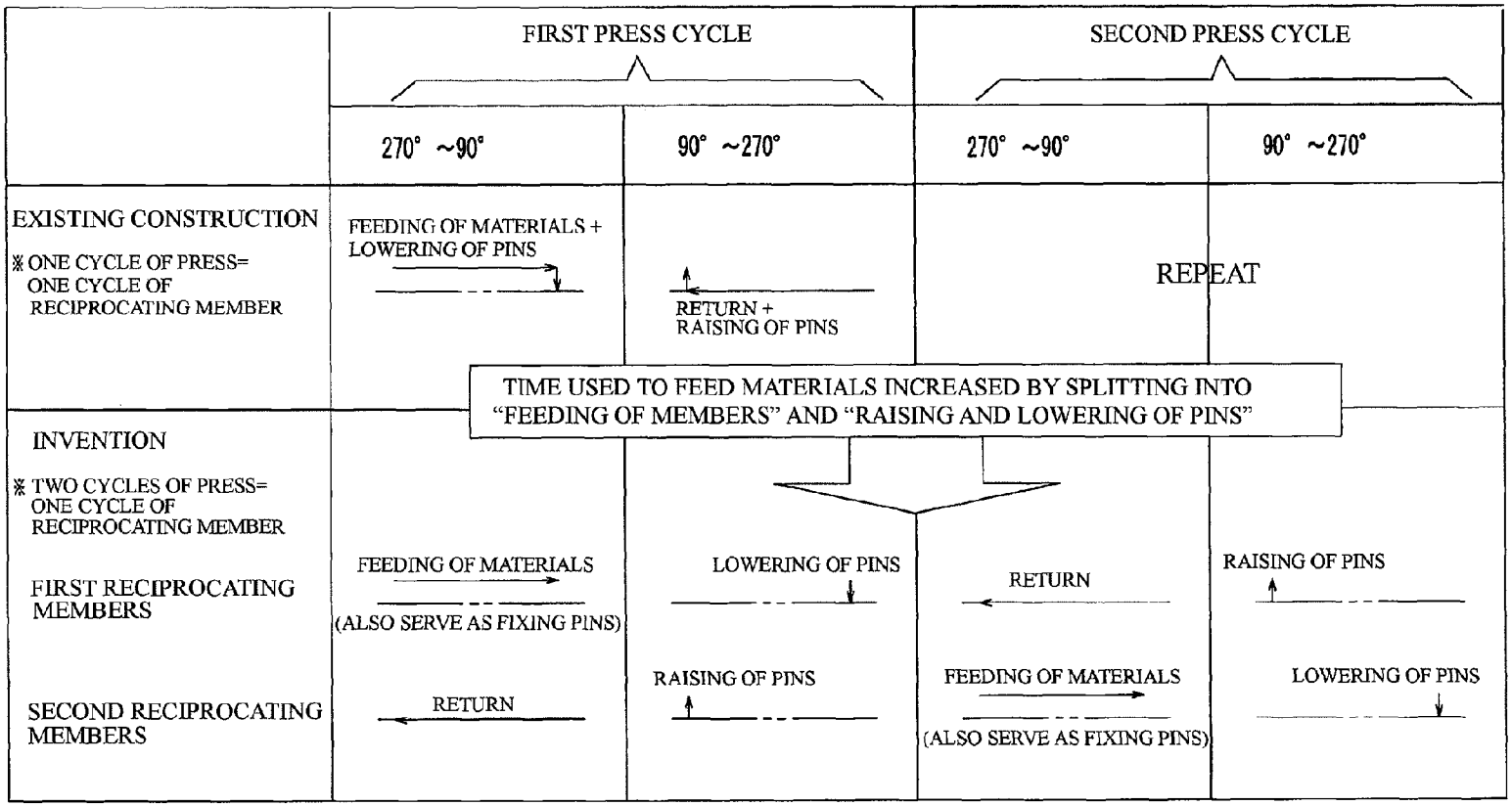
FIG. 1 is a diagram useful in schematically depicting a feeding operation of metal strips by a manufacturing apparatus for heat exchanger fins according to the present invention.
Figure 2:
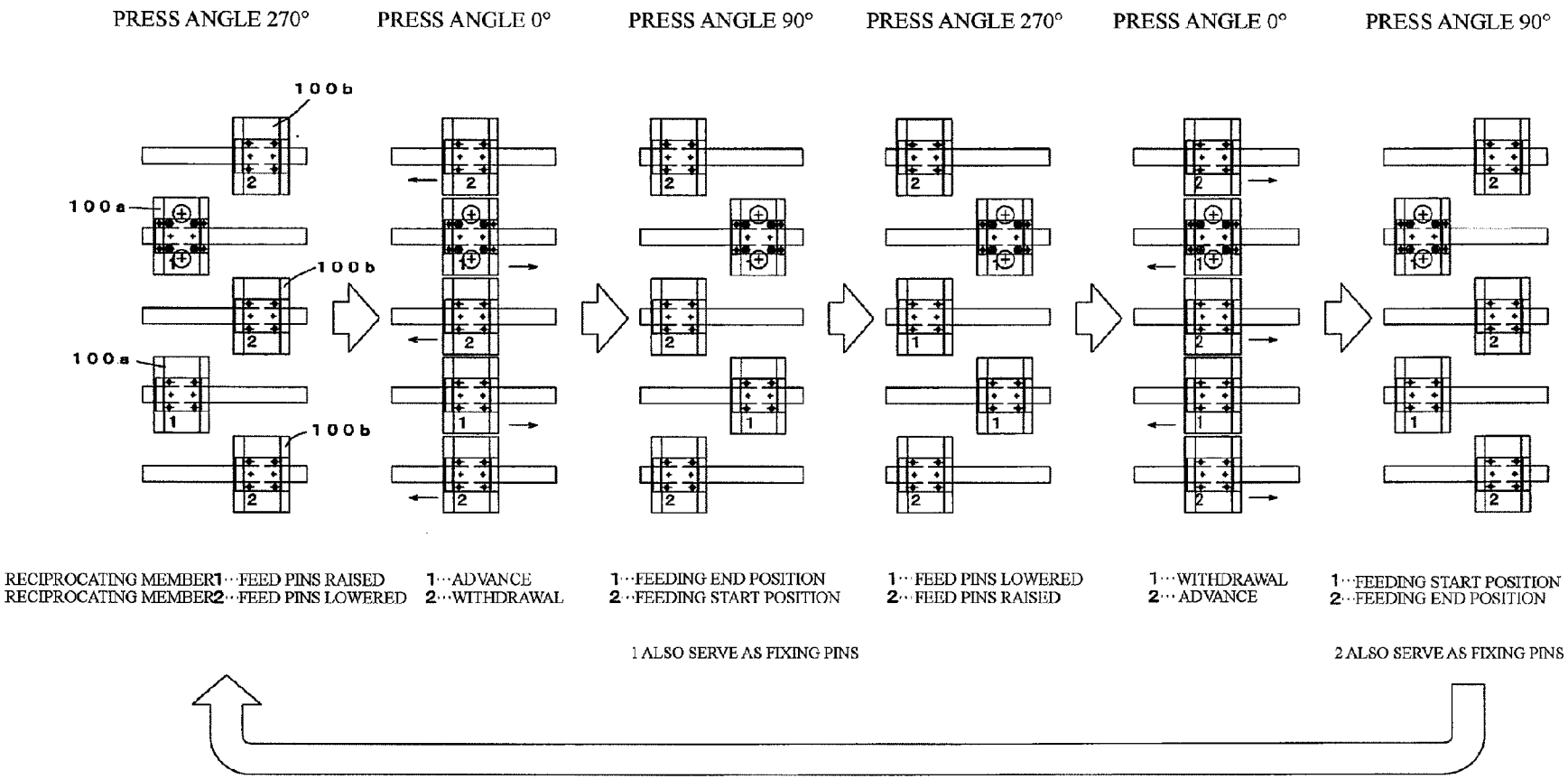
FIG. 2 is a diagram useful in further explaining the diagram in FIG. 1.

FIG. 1 is a diagram useful in explaining a case where the concept of the present invention is compared with the operation of an existing reciprocating member. FIG. 2 is a diagram useful in schematically depicting a specific example of the operating concept of the reciprocating members depicted in FIG. 1. First, in a feeding apparatus 101 according to the present invention, a plurality of reciprocating members 100, 100 that respectively include feed pins 68 are provided. In an up-down operation of the press apparatus 18, 0° is the upper dead point and 180° is the lower dead point. In a half cycle from 270° to 90° out of one cycle of up-down movement, the feed pins 68 of first reciprocating members 100*a* are inserted inside the through-holes 11 of the metal strips 10 so that the reciprocating members 100*a* convey the metal strips 10. At this time, second reciprocating members 100*b* move in the return direction. In the next half cycle from 90° to 270°, the feed pins 68 of the reciprocating members 100*a* are lowered and the feed pins 68 of the other reciprocating members 100*b* are raised.

Next, in the half cycle from 270° to 90° out of a second cycle that is the next up-down operation of the press apparatus 18, the first reciprocating members 100*a* move in the return direction. At this time, the feed pins 68 of the second reciprocating members 100*b* are inserted inside the through-holes 11 of the metal strips 10 so that the reciprocating members 100*b* convey the metal strips 10. In the next half cycle from 90° to 270°, the feed pins 68 of the first reciprocating members 100*a* are raised and the feed pins 68 of the second reciprocating members 100*b* are lowered.

In this way, with the feeding apparatus 101 according to the present invention, compared to the past when it was necessary to carry out a raising operation and lowering operation of the feed pins 68 and conveyance of the metal strips 10 in half cycles, it is possible to increase the time spent conveying the metal strips 10 and to reduce the load on the metal strips 10 due to sudden acceleration and sudden deceleration.

Figure 3:
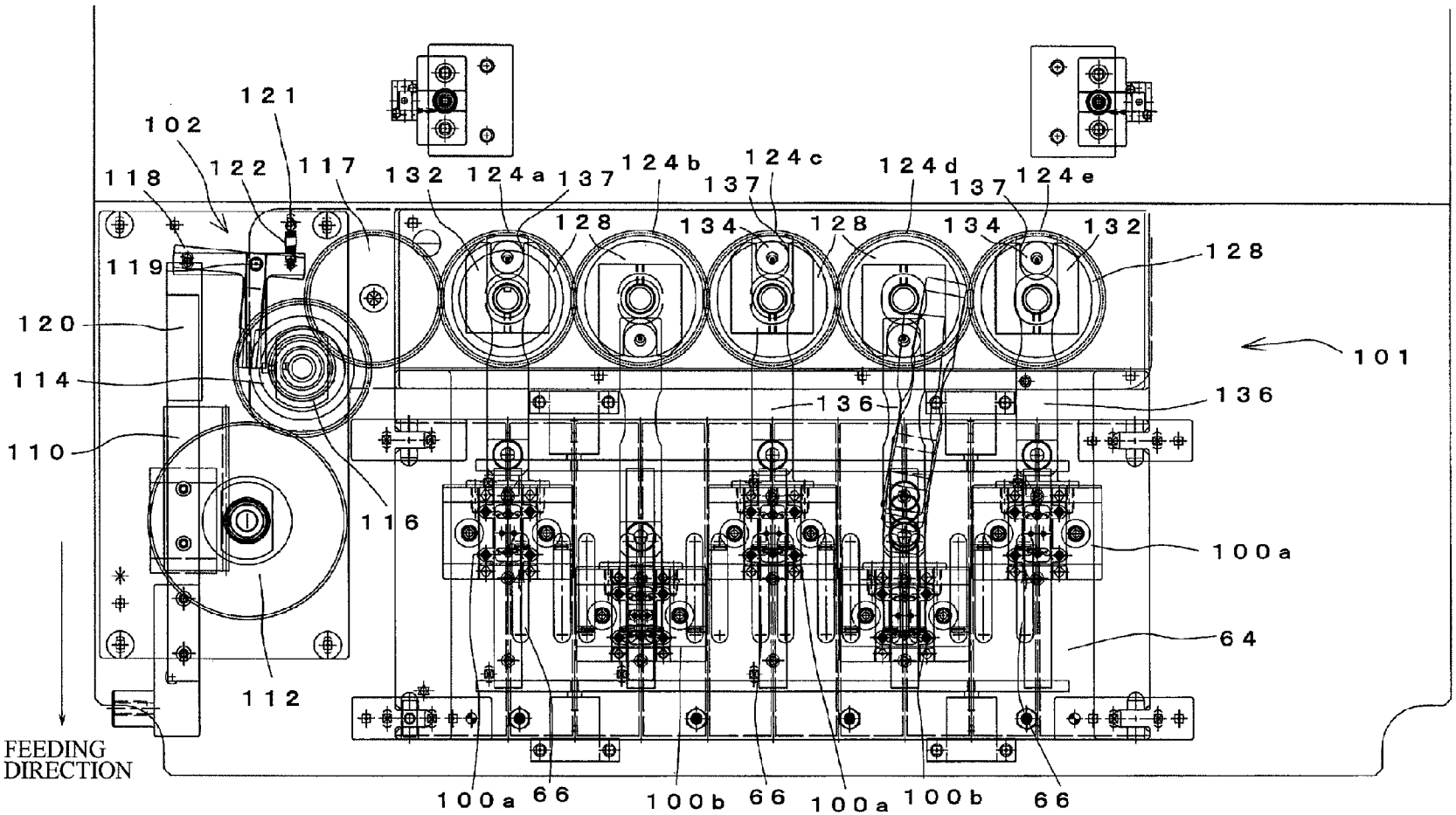
FIG. 3 is a plan view of a feeding apparatus.
Figure 4:
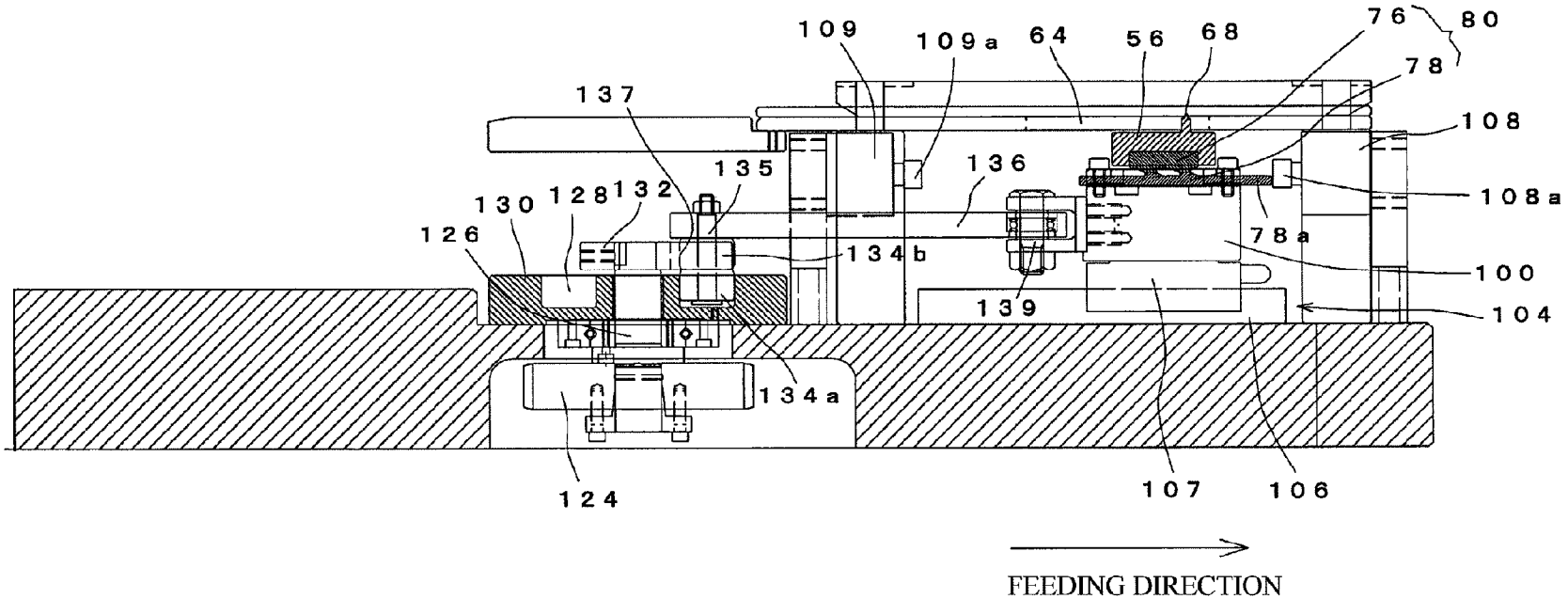
FIG. 4 is a side view of a feeding apparatus.

FIG. 3 is a plan view of a specific feeding apparatus according to a first embodiment. FIG. 4 is a side view of the feeding apparatus depicted in FIG. 3. In the first embodiment, five reciprocating members 100 are aligned in the width direction, with the respective reciprocating members 100 moving in alternating directions. Note that in FIG. 3, the five reciprocating members 100 are composed of three reciprocating members 100*a* at the return position and two reciprocating members 100*b* that have advanced in the feeding direction. In the present embodiment, the "first reciprocating member group" referred to in the patent claims corresponds to the three reciprocating members 100*a* and the "second reciprocating member group" corresponds to the two reciprocating members 100*b*.

Overall Construction of Feeding Apparatus

The feeding apparatus 101 includes the reference plate 64 on whose upper surface the metal strips 10 are placed, the plurality of the reciprocating members 100*a*, 100*b* on which the feed pins 68 are provided, and a driving means 102 that reciprocally moves the reciprocating members 100*a*, 100*b* in the feeding direction of the metal strips 10. A slit 66 is formed in the reference plate 64 so as to pass through from the upper surface to the lower surface of the reference plate 64 and to extend along the feeding direction of the metal strips 10. The feed pins 68 advance into this slit 66 from below and protrude upward from the reference plate 64.

A guide apparatus 104 that is disposed along the feeding direction is provided for each of the reciprocating members 100*a*, 100*b*. In order to guide the linear movement of each reciprocating member efficiently with low resistance, each guide apparatus 104 includes a rail portion 106 and a moving portion 107 capable of linear movement on the rail portion 106 with low resistance, with the lower portion of each reciprocating member 100 being attached to the moving portion 107.

Driving Means

Figure 16:
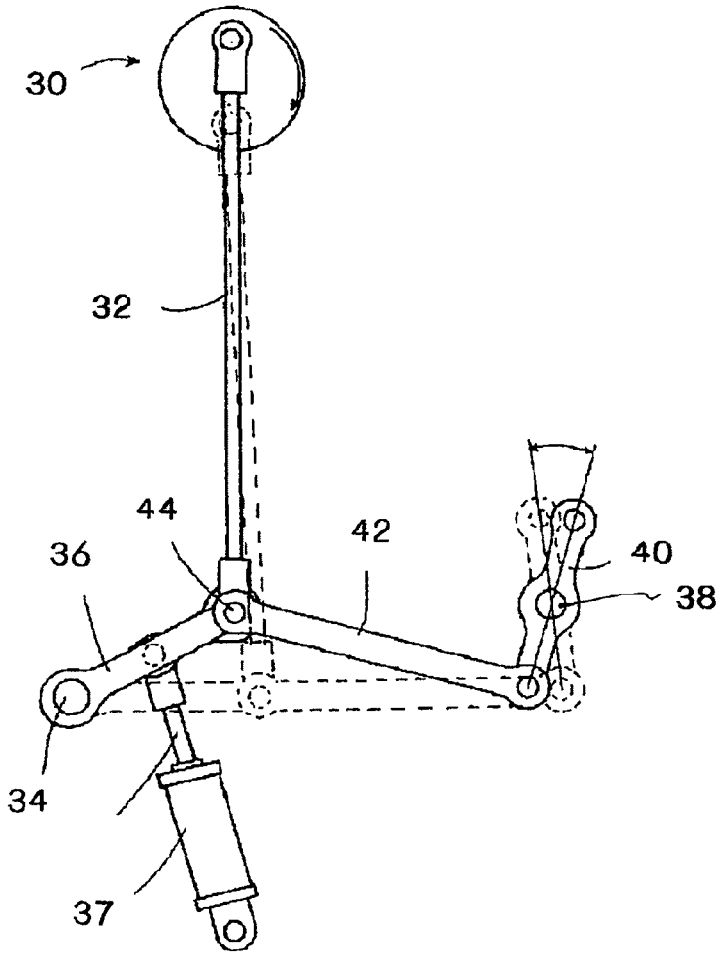
FIG.16 PRIOR ART
FIG. 16 is a diagram depicting a driving means that reciprocally moves the reciprocating member according to a press operation of a press apparatus.
Figure 17:
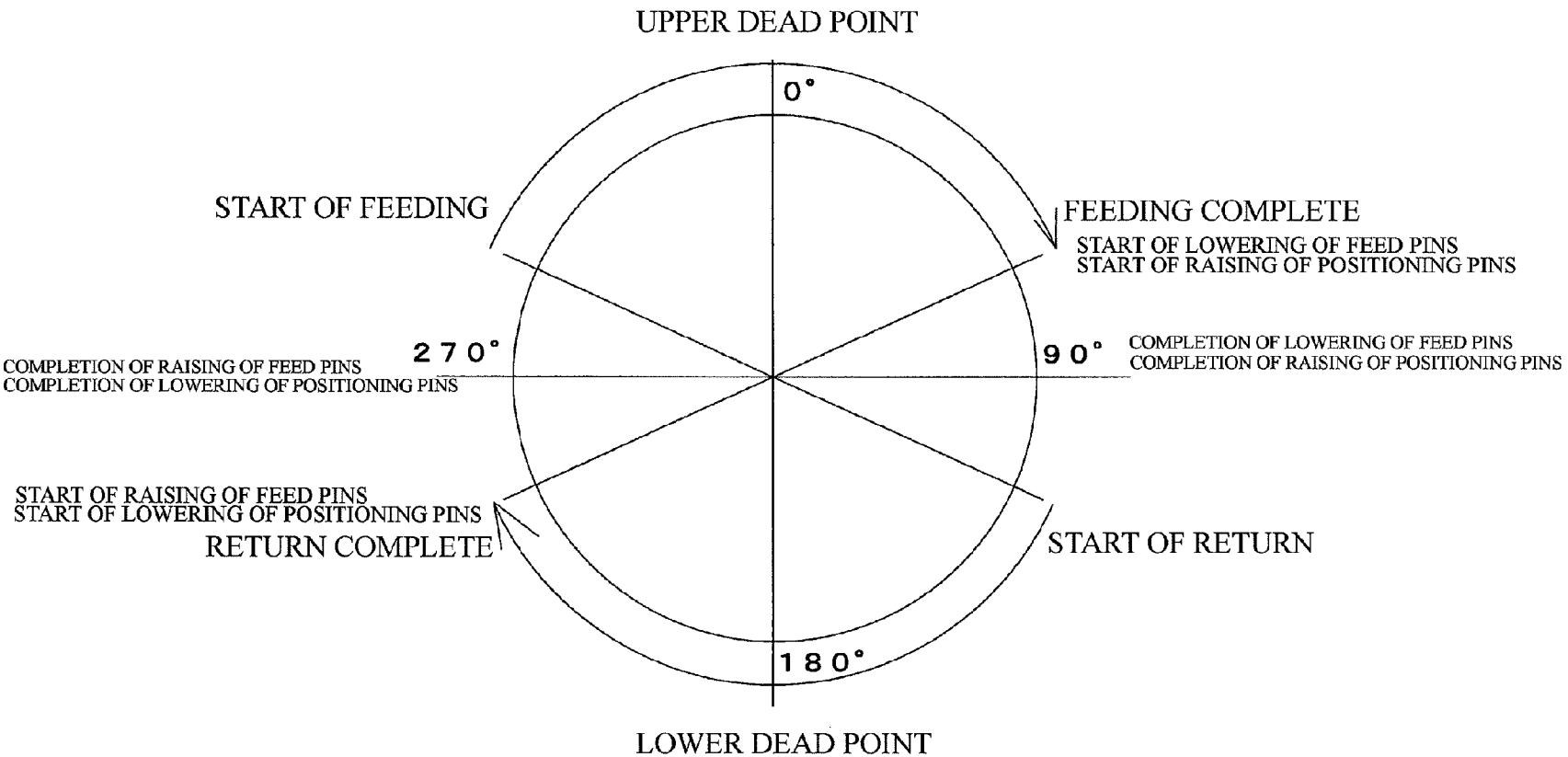
FIG.17 PRIOR ART
FIG. 17 is a diagram useful in explaining the feed timing of a metal strip based on an existing press operation.
Figure 18:
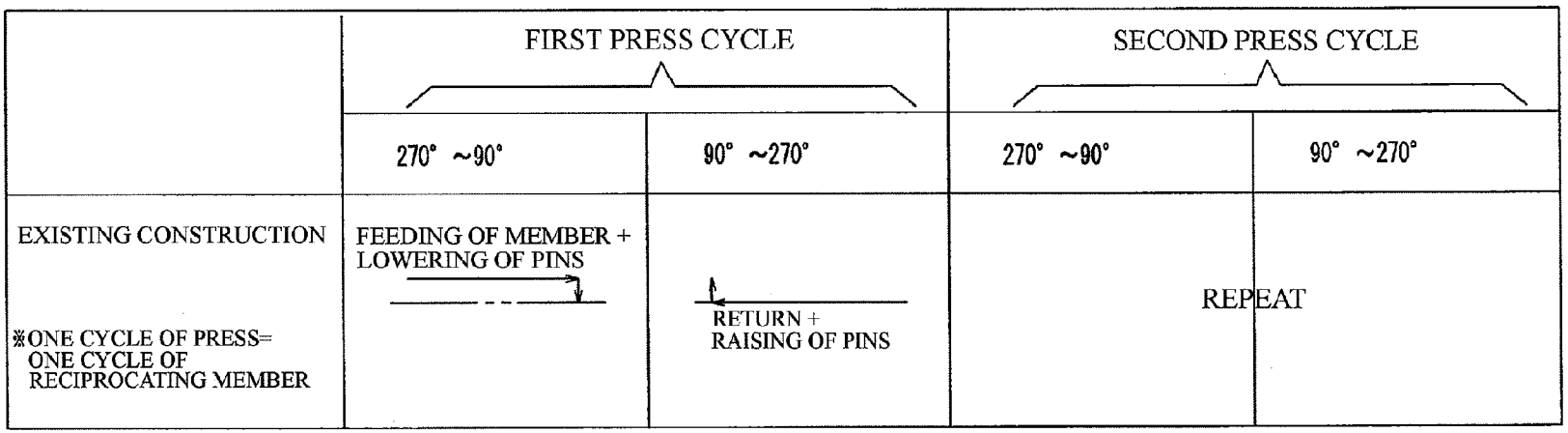
FIG.18 PRIOR ART
FIG. 18 is a table depicting the relationship between a press operation and a feeding operation of the metal strip based on FIG. 17.

The driving means 102 includes a link portion that converts an up-down operation of the press apparatus 18 to reciprocal movement. Since the construction of the link portion is the same as FIG. 16 that was described in the "Background" section, such link portion is not illustrated or described here. Due to the reciprocal movement along the feeding direction outputted by the link portion depicted in FIG. 16, a rack 110 moves reciprocally along the feeding direction.

A gear mechanism constructed of a plurality of gears is connected to the rack 110. This gear mechanism converts the reciprocal movement of the rack 110 to rotational movement. The gear mechanism according to the present embodiment includes a first gear 112 that meshes the rack 110, a clutch mechanism 114 that meshes the first gear 112 and converts rotational movement of the first gear 112 to rotational movement in only one direction, a second gear 116 provided on the same shaft as the clutch mechanism 114, and a third gear 117 that meshes the second gear 116 and outputs a rotational force to a final output gear.

Figure 5:
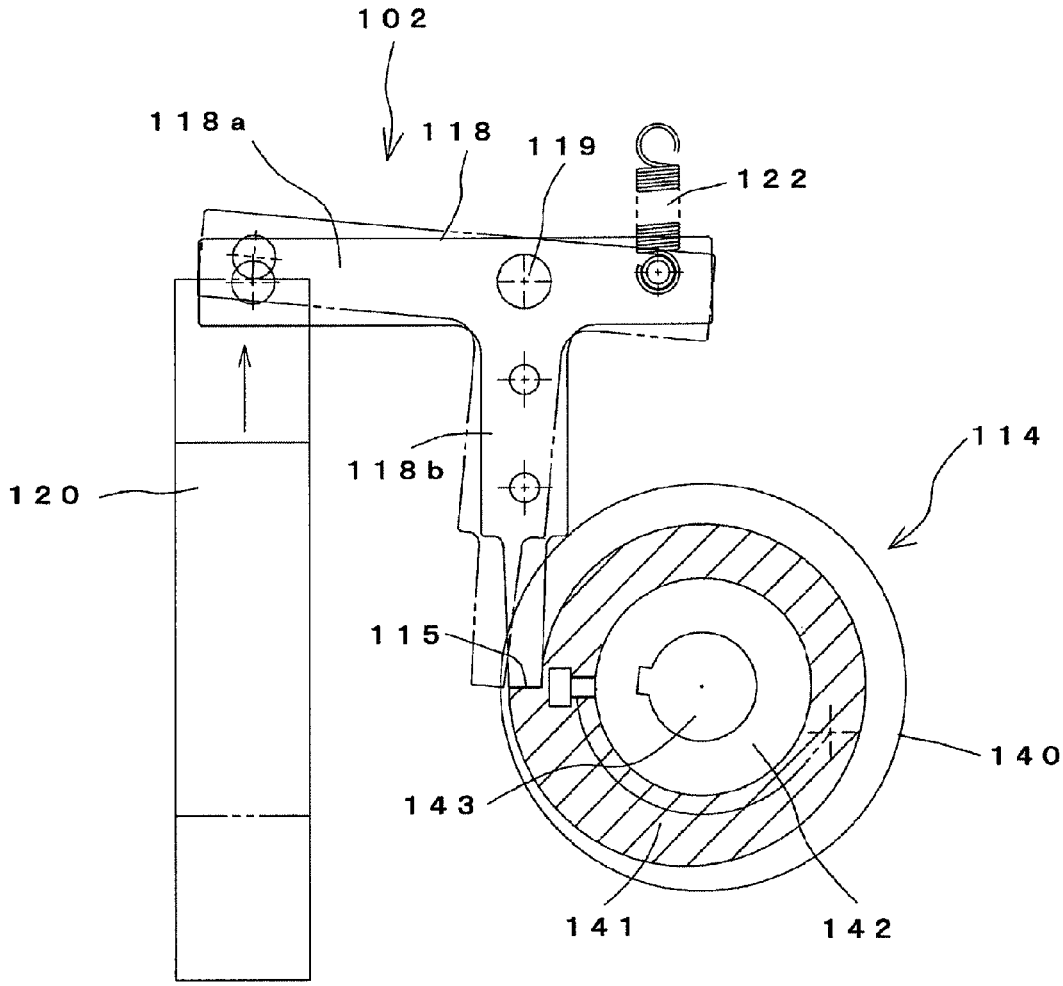
FIG. 5 is a diagram useful in depicting the construction of a clutch mechanism in a driving means.

The clutch mechanism 114 and the construction for operating the clutch mechanism 114 are depicted in FIG. 5. As the clutch mechanism 114, a clutch called a "one-revolution clutch" is used. The clutch mechanism 114 includes a large-diameter outer disc 140, a small-diameter inner disc 142 disposed on the same shaft as the outer disc 140, a clutch portion 141, and a rotational shaft 143 disposed in the center of the outer disc 140 and the inner disc 142. Clutch engagement and disengagement of the clutch mechanism 114 will now be described. A stepped portion 115 is formed on the outer circumferential surface of the clutch portion 141, and when a lever 118 provided so as to move in concert with operation of the rack 110 contacts the stepped portion 115, the clutch is disengaged and placed in a state where rotation of the outer disc 140 is not transmitted to the inner disc 142. By separating the lever 118 from the stepped portion 115 the clutch is engaged and placed in a state where rotation of the outer disc 140 is transmitted to the inner disc 142. Note that the actual mechanism of this type of one-revolution clutch is well known.

The lever 118 is formed so as to be approximately T-shaped when viewed from above and is composed of an upper bar 118*a* of the T shape and the center bar 118*b* that extends downward in FIG. 5 from the center of the upper bar 118*a*. The lever 118 is provided so as to be capable of rotating on a horizontal plane with an intersecting part of the upper bar 118*a* and the center bar 118*b* as a center axis 119. An end portion at one end of the upper bar 118*a* of the lever 118 that extends in the left-right direction in FIG. 5 is linked to a front end portion of a reciprocating lever 120 that is linked to the rack 110 and extends in the conveying direction. Also, an extension spring 122 is provided between the other end portion of the upper bar 118*a* of the lever 118 and a support 121 erected on the body of the feeding apparatus 101.

The front end portion of the center bar 118*b* of the lever 118 is located so as to contact the stepped portion 115 of the inner disc 142 of the clutch mechanism 114. Contact between the front end portion of the center bar 118*b* of the lever 118 and the stepped portion 115 occurs due to the balance between the operation of the reciprocating lever 120 and the extension spring 122 that are connected to both end portions of the lever 118.

When the reciprocating lever 120 has moved toward the upper end in FIG. 5 (i.e., in the opposite direction to the feeding direction), the end portion on the opposite side of the reciprocating lever 120 to the feeding direction pushes one end of the upper bar 118*a* of the lever 118 upward in the drawing (i.e., in the opposite direction to the feeding direction). When this happens, the lever 118 resists the pulling force of the extension spring 122 and rotates about the center axis 119 in the clockwise direction (when viewed from above) so that the front end portion of the center bar 118*b* becomes separated from the stepped portion 115. This corresponds to the 270° position in the cycle of the press apparatus 18.

When the lever 118 is removed from the stepped portion 115, due to the rotational force provided by the first gear 112 that meshes the rack 110, the outer disc 140 of the clutch mechanism 114 rotates clockwise when viewed from above. Since the reciprocating lever 120 moves downward in the drawing (i.e., in the feeding direction), the lever 118 rotates anti-clockwise due to the pulling force of the extension spring 122. For this reason, the front end portion of the center bar 118*b* of the lever 118 is pressed against the outer circumferential surface of the clutch portion 141 of the clutch mechanism 114 and the inner disc 142 will continue to rotate. While the reciprocating lever 120 is moving downward in the drawing (i.e., in the feeding direction), the 0° position in the cycle of the press apparatus 18 is reached.

When the reciprocating lever 120 is positioned at the bottom end in the drawing (i.e., in the feeding direction), i.e., at the 90° position in the cycle of the press apparatus 18, the inner disc 142 will have made exactly one revolution. When this happens, the front end portion of the center bar 118*b* of the lever 118 fits into the stepped portion 115, the clutch is disengaged, and the rotation of the inner disc 142 stops.

The reciprocating lever 120 starts to rise from the bottom end in the drawing (i.e., in the feeding direction), and before reaching the upper end in the drawing (i.e., in the opposite direction to the feeding direction), the 180° position in the cycle of the press apparatus 18 is reached. At this time, due to the first gear 112 meshing with the rack 110, the first gear 112 will be rotating in the opposite direction to before. Accordingly, the outer disc 140 that meshes the first gear 112 will be rotating anti-clockwise when viewed from above, which is rotation in the opposite direction to before. However, since the clutch mechanism 114 is disengaged at this time, the anti-clockwise rotation of the outer disc 140 is not transmitted to the rotational shaft 143.

The second gear 116 is provided below the rotational shaft 143 of the clutch mechanism 114. Since the rotational shaft 143 rotates only when the clutch mechanism 114 rotates clockwise when viewed from above in the present embodiment, the second gear 116 only rotates clockwise when viewed from above. Rotation of the second gear 116 corresponds to 270° to 90° for the press apparatus described earlier.

A configuration is used where the third gear 117 meshes the second gear 116 and the gear ratio of the third gear 117 to the second gear 116 is 2:1. Accordingly, when the second gear 116 makes one revolution, the third gear 117 makes a half revolution. The gear ratio of the third gear 117 and the final output gear 124 that meshes the third gear 117 is 1:1. By doing so, the third gear 117 makes a half revolution relative to the second gear 116 that makes one revolution in a half cycle of the press, and the final output gear 124 that has a 1:1 gear ratio with the third gear 117 also makes a half revolution. In this way, in a half cycle of the press, the final output gear 124 is capable of causing each of the reciprocating members 100 to carry out one of a feeding operation and a return operation.

Note that although a case where the gear ratio of the second gear 116 and the third gear 117 is 2:1 has been described above, for the present invention, the gear ratio of the second gear 116 and the final output gear 124 may be 2:1. Accordingly, a configuration may be used where the second gear 116 and the final output gear 124 are directly meshed to produce a gear ratio of 2:1 without providing the third gear 117.

By providing the clutch mechanism 114 as described above, a raising operation and a lowering operation of the feed pins 68 are carried out in half a cycle of one up-down operation of the press apparatus 18 without a reciprocal movement operation being carried out. It is possible to have only reciprocal movement of the reciprocating members 100*a*, 100*b* carried out in the remaining half cycle.

Returning to FIG. 3 and FIG. 4, the construction that moves the reciprocating members 100*a*, 100*b* will now be described. The third gear 117 meshes one out of a plurality of (in the present embodiment, five) final output gears 124*a* to 124*e* for moving the reciprocating members 100*a*, 100*b*. The respective gears out of the final output gears 124*a* to 124*e* move the reciprocating members 100*a*, 100*b* and, in the same way as the reciprocating members 100*a*, 100*b* that are disposed so as to be aligned in the width direction (a direction that is perpendicular to the feeding direction), are aligned in the width direction so as to mesh one another.

The third gear 117 that meshes one gear (in the present embodiment, the final output gear 124*a*) out of the aligned final output gears 124*a* to 124*e* transmits the rotational force transmitted from the second gear 116 to the final output gear 124*a*. Out of the five final output gears 124*a* to 124*e*, the final output gear 124*a* that meshes the third gear 117 rotates in the opposite direction to the third gear 117 and the neighboring final output gear 124*b* that meshes the final output gear 124*a* rotates in the opposite direction to the final output gear 124*a*. In this way, the final output gears 124*a* to 124*e* that are aligned so as to mesh one another are provided so that gears that are adjacent to one another rotate in respectively opposite directions.

Next, a construction for converting the rotational force of the respective final output gears 124 to reciprocal movement of the reciprocating members 100 will be described. A plate-like link member 132 that rotates together with a rotational shaft 126 of each final output gear 124 is provided on the rotational shaft 126. Each link member 132 in the present embodiment is a plate-like member that is substantially rectangular when viewed from above and has an upper end portion of the rotational shaft 126 attached to a substantially central position thereof. A cutaway portion 137 is formed in part of the link member 132 and a roller 134*b* is housed inside the cutaway portion 137.

The roller 134*b* is rotatably attached to a shaft 135 that passes through in the up-down direction and a roller 134*a* is rotatably attached to the shaft 135 at a lower end portion of the shaft 135. A grooved cam 130 where an oval groove 128 is formed is disposed around the rotational shaft 126 of the rectangular link member 132. The groove 128 is formed with the rotational shaft 126 in the center, the roller 134*a* mentioned earlier is housed inside the groove 128 of the grooved cam 130, and the roller 134*a* moves so as to rotate inside the groove 128 formed so as to be centered on the rotational shaft 126 while contacting an inner wall surface of the groove 128. The grooved cam 130 according to the present embodiment is a plate-like member that extends in the width direction and the groove 128 is formed above each final output gear 124.

The shaft 135 described earlier is provided at one end of a link arm 136. The link arm 136 is provided to link the link member 132 and a reciprocating member 100, and the link arm 136 is moved by movement of the roller 134*b* housed in the cutaway portion 137 of the link member 132. The other end of the link arm 136 is attached via a shaft 139 to the reciprocating member 100 so as to be rotatable. That is, the link arm 136, the link member 132, and the rollers 134*a*, 134*b* construct a crank that reciprocally move the link arm 136 according to rotation of the link member 132.

Figure 6:
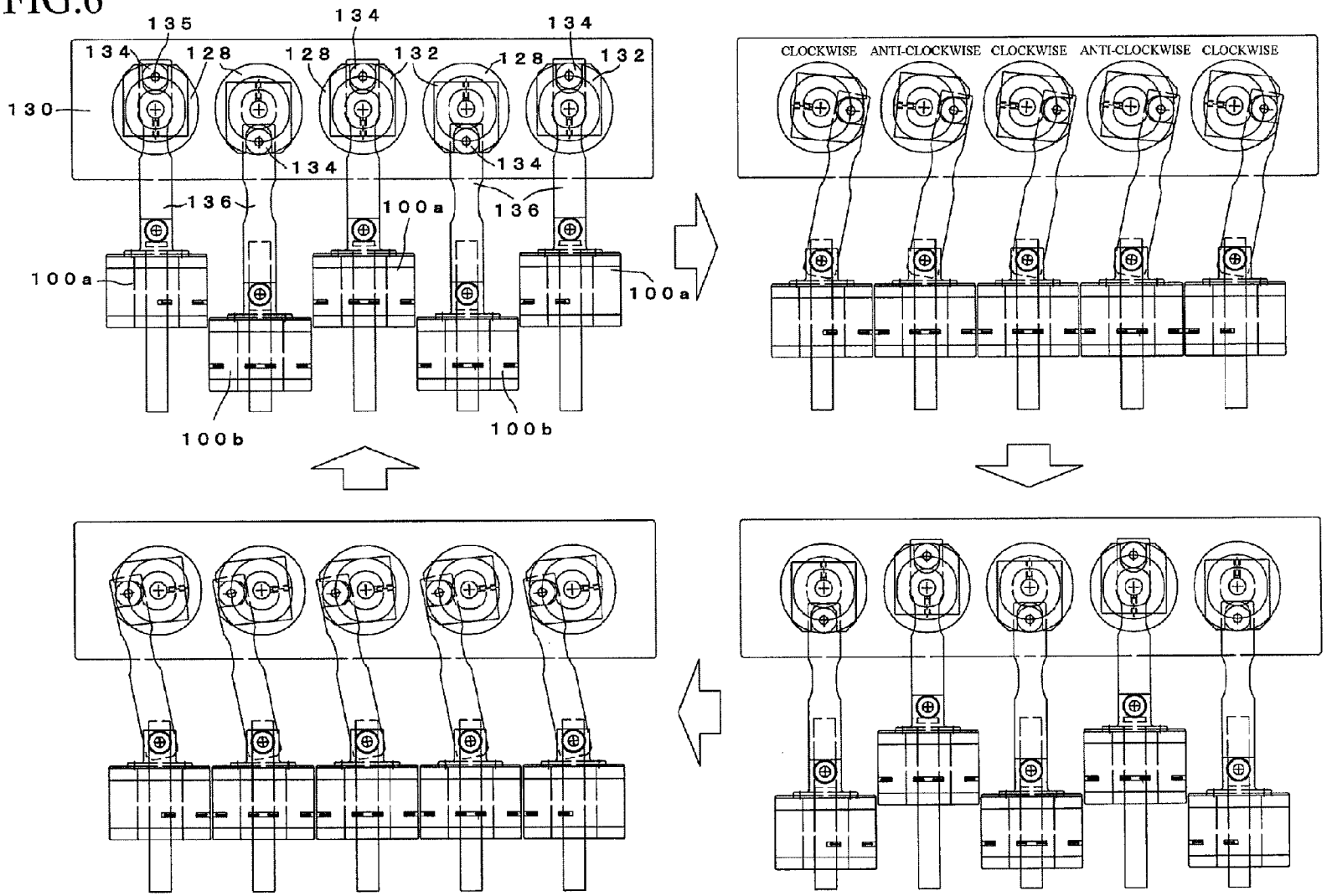
FIG. 6 is a diagram useful in explaining the operation of reciprocating members according to an embodiment of the present invention.

An operation of the reciprocating member based on such mechanism will now be described with reference to FIG. 6. The link member 132 rotates on a horizontal plane in accordance with rotational movement of the rotational shaft 126 of the final output gear 124. Neighboring shafts out of the rotational shafts 126 of the final output gears 124 described above rotate in respectively different directions. In FIG. 6, the shafts are disposed so as to rotate clockwise, anti-clockwise, clockwise, . . . in order from the left of the drawing.

Due to the rotation of the link member 132, the roller 134*b* housed in the cutaway portion 137 of the link member 132 is moved around the rotational shaft 126. Since the roller 134*a* provided at the lower end of the shaft 135 is housed inside the groove 128 of the grooved cam 130, the shaft 135 traces the planar form of the groove 128. Due to the circular (more precisely, oval) movement based on the roller 134*a* moving inside the groove 128, the link arm 136 moves reciprocally. This results in each reciprocating member 100 moving reciprocally in the feeding direction and the opposite direction.

Note that the form of the groove 128 is oval with the major axis in the feeding direction. That is, the groove 128 is shaped so that in the periphery of 270° and 90° of a press operation, the movement distance in the feeding direction is short compared to other parts of the press operation. This means that movement of the reciprocating members 100 in the feeding direction is reduced near the start of feeding and the end of feeding, and movement in the feeding direction stops at the start of feeding and the end of feeding. By doing so, it is possible to prevent a sudden starting and a sudden stopping at the start of feeding and the end of feeding, and thereby possible to reduce the load applied to the metal strips 10.

Construction of Feed Pins

Next, the construction of the feed pins will be described with reference to FIG. 4. A pin block 56 that has feed pins 68 disposed so as to protrude upward is provided on the upper surface of each reciprocating member 100. The pin block 56 is energized downward (i.e., toward the reciprocating member 100) by an energizing means such as a spring, not depicted. The pin block 56 is capable of moving together with the reciprocating member 100 and when an upward force acts on the pin block 56 against the energizing force of the energizing means, the pin block 56 rises toward the reference plate 64 and raises the feed pins 68.

An up-down cam portion 80 is provided between each reciprocating member 100 and each pin block 56. The up-down cam portion 80 is composed of an upper cam portion 76 fixed to the pin block 56 side and a lower cam portion 78 provided on the reciprocating member 100 side. Concave and convex portions are formed on facing surfaces of the upper cam portion 76 and the lower cam portion 78. The upper cam portion 76 is provided so that concave and convex portions protrude downward at a lower portion of the pin block 56. The lower cam portion 78 is formed on the upper surface of the wide member 78*a* that is wider (i.e., longer in the conveying direction) than the reciprocating member 100 and formed so as to protrude beyond the reciprocating member 100 and the pin block 56 toward both ends in the conveying direction. The concave and convex portions of the lower cam portion 78 are formed so as to protrude upward. Accordingly, the concave and convex portions of the upper cam portion 76 and the lower cam portion 78 are disposed so as to face one another.

The wide member 78*a* of the lower cam portion 78 is slidably provided on the upper surface of the reciprocating member 100. Due to the wide member 78*a* sliding, the contacting positions of the concave and convex portions of the upper cam portion 76 and the concave and convex portions of the lower cam portion 78 shift, so that the pin block 56 is moved up and down and the feed pins 68 are raised or lowered. When the convex portions of the upper cam portion 76 and the lower cam portion 78 are in contact, the pin block 56 is raised and the feed pins 68 protrude upward from the slit 66 in the reference plate 64. Conversely, when the concave and convex portions of the upper cam portion 76 and the lower cam portion 78 fit together, the pin block 56 is lowered and the feed pins 68 are lowered from the slit 66 in the reference plate 64.

In the present embodiment, as an up-down movement means for causing the wide member 78*a* of the lower cam portion 78 to slide and the feed pins 68 to move up and down, two air cylinders 108 and 109 are used for one reciprocating member 100. The air cylinders 108 and 109 are respectively provided near an initial position (start position) and a final position (end position) in the feeding direction of the reciprocating member 100. The air cylinder 108 disposed near the final position presses out a rod 108*a* at the end of conveyance to cause the wide member 78*a* to slide and lower the feed pins 68. The air cylinder 109 disposed near the initial position presses out a rod 109*a* at the end of a return operation which causes the wide member 78*a* to slide and raise the feed pins 68.

Note that the air cylinders 108 and 109 in the present embodiment are not connected to the driving means 102 that converts up-down movement of the press apparatus 18 to reciprocal movement to drive the reciprocating member 100 and are instead controlled by a control unit (not depicted) separately to the operation of the driving means 102. That is, as described above, since an up-down operation of the feed pins 68 is carried out in a half cycle of the up-down operation of the press apparatus 18 in which the reciprocating members 100 do not move, it is believed that it would be difficult to drive the feed pins 68 using the driving means 102 which will have stopped at such time.

Note that in a manufacturing apparatus for heat exchanger fins according to the present invention, there is no need for positioning pins for holding the metal strips 10 during a press machining operation, and by keeping the feed pins 68 that have fed the metal strips 10 in the feeding direction inserted in the through-holes 11, it is possible to achieve the same effect as the positioning pins used in the past. As depicted in FIG. 2, since a press operation is carried out in the next cycle after the end of a feeding operation and there is no movement of the reciprocating member 100 in such half cycle, it is possible to keep the feed pins 68 inserted in the through-holes 11.

Second Embodiment

Figure 7:
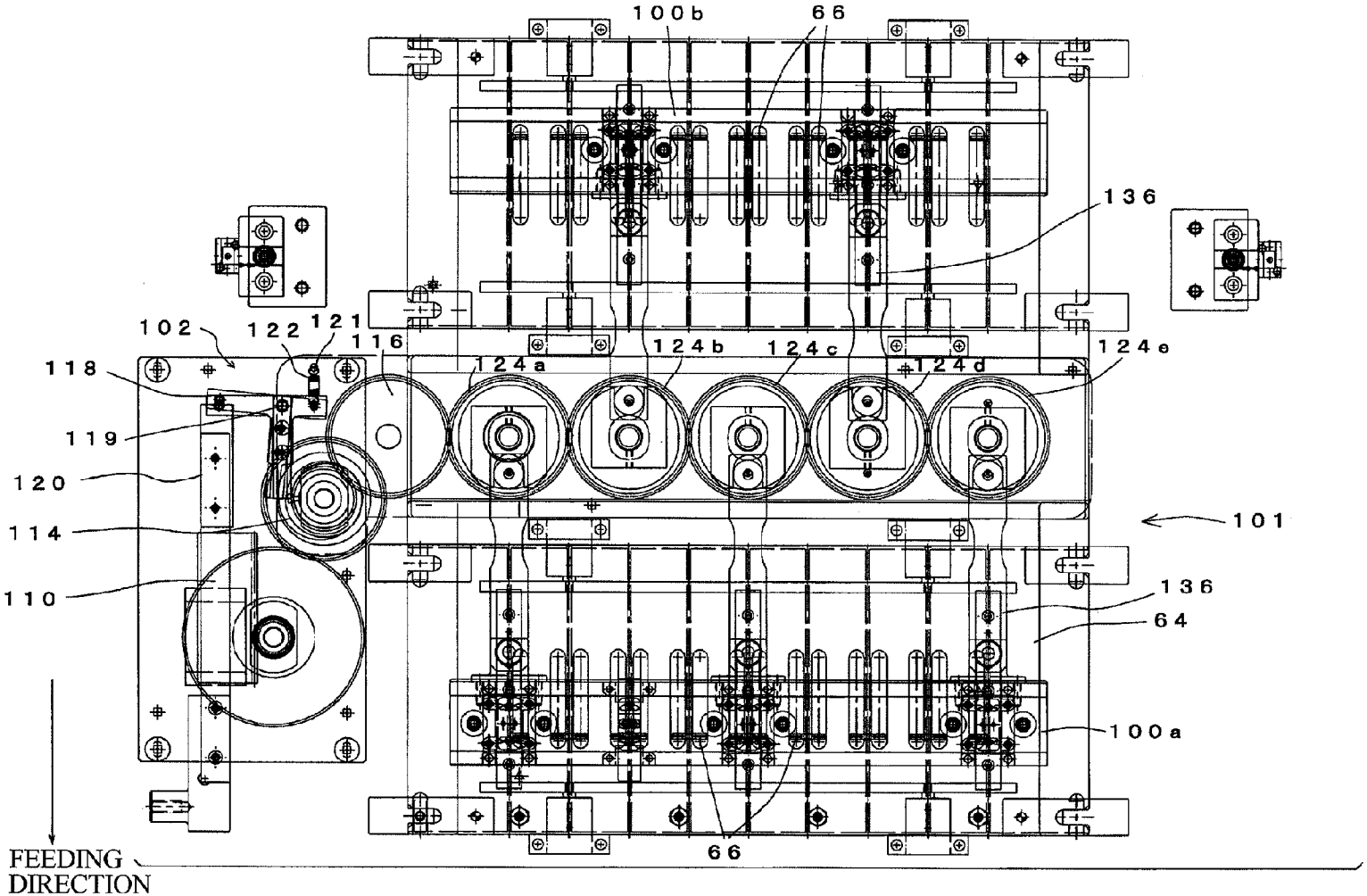
FIG. 7 is a plan view of a second embodiment of a feeding apparatus.

Next, an embodiment in which the reciprocating members are disposed differently to the above embodiment will be described. Note that component elements that are the same as in the embodiment described above have been assigned the same reference numerals and description thereof is omitted. As depicted in FIG. 7, in the present embodiment, adjacent reciprocating members that move in opposite directions are located on opposite sides of the final output gears 124 in the feed direction. In addition, only one reciprocating member 100*a* and one reciprocating member 100*b* that move in opposite directions are provided.

Here, only the disposed positions and number of the reciprocating members 100*a*, 100*b* differ to the above embodiment, and the remaining construction and operation are the same. Note that the number of final output gears 124*a* to 124*e* is the same (five) as in the embodiment described above and a plurality of link arms 136 are commonly attached to the reciprocating members 100*a*, 100*b* that are formed so as to extend in the width direction. That is, the link arms 136 that are respectively provided for the final output gears 124*a*, 124*c*, and 124*e* are attached so as to face forward in the feeding direction and the three link arms 136 are attached to the single reciprocating member 100*a*. On the other hand, the link arms 136 that are respectively provided for the final output gears 124*b* and 124*d* are attached facing in the opposite direction (backward) to the feeding direction and the two link arms 136 are attached to the single reciprocating member 100*b*.

By using this construction, compared to the past when it was necessary to carry out a raising operation and a lowering operation of the feed pins 68 as well as conveyance of the metal strips 10 in a half cycle, it is possible to increase the time spent conveying the metal strips 10 and to reduce the load applied to the metal strips 10 due to sudden acceleration and sudden deceleration.

Note that the construction of the driving means 102 that causes the reciprocating members 100 to move reciprocally is not limited to the same construction as the embodiments described above. That is, the number of gears does not need to be equal to the embodiments described above and it is possible to further add gears at intermediate positions.

Although the present invention has been described above by way of the preferred embodiments, the present invention is not limited to such embodiments and it should be obvious that various modifications may be implemented without departing from the scope of the invention.

What is claimed is:

1. A manufacturing apparatus for heat exchanger fins comprising:

a press apparatus that forms metal strips by aligning a plurality of thin metal plates in a feeding direction of the metal plates and in a width direction that is a direction perpendicular to the feeding direction and forming, by press machining, a plurality of through-holes; and a feeding apparatus that feeds the metal strips formed by the press apparatus in the feeding direction, wherein the feeding apparatus includes:

a reference plate on whose upper surface the metal strips are placed and in which a slit that extends in the feeding direction of the metal strips is formed so as to pass through from the upper surface to a lower surface of the reference plate;

a plurality of reciprocating members that are provided below the reference plate, move reciprocally in parallel to the reference plate in the feeding direction of the metal strips and an opposite direction, and are provided with feed pins, which are capable of up-down movement toward the reference plate and whose front end portions are inserted into the through-holes of the metal plates placed on the reference plate; and driving means that converts up-down movement of the press apparatus to reciprocal movement in the feeding direction and the opposite direction and causes the reciprocating members to move reciprocally, wherein the plurality of reciprocating members are split into two groups that move reciprocally with respectively different orders, and wherein in a predetermined half cycle out of one cycle of the up-down movement of the press apparatus, the driving means drives the groups of the reciprocating members so that a first reciprocating member group out of the two reciprocating member groups carries out a feeding process where the first reciprocating member group moves in the feeding direction with the feed pins inserted inside the through-holes of the metal strips and a second reciprocating member group out of the two reciprocating member groups carries out a return process where the second reciprocating member group returns in the opposite direction to the feeding direction in a state were the feed pins are lowered, and in a remaining half cycle, the driving means carries out a lowering process for the feed pins of the first reciprocating member group and a raising process for the feed pins of the second reciprocating member group but does not drive the reciprocating member groups in the feeding direction or the opposite direction.

2. A manufacturing apparatus for heat exchanger fins according to claim 1, wherein the driving means includes:

a link portion that converts the up-down movement of the press apparatus to reciprocal movement in the feeding direction and the opposite direction;

a rack that is moved reciprocally by the link portion;

a gear mechanism that meshes the rack and converts reciprocal movement of the rack to rotational movement;

a clutch mechanism that is provided inside the gear mechanism and converts only movement in one direction out of the reciprocal movement of the rack to rotational movement in one direction;

a plurality of final output gears that are aligned and mesh one another in the width direction so as to finally output from the gear mechanism to the plurality of reciprocating members; and a plurality of link arms that link the final output gears and the respective reciprocating members to convert the rotational movement of the final output gears to reciprocal movement of the respective reciprocating members.

3. A manufacturing apparatus for heat exchanger fins according to claim 1, wherein up-down movement means, which move the feed pins of the respective reciprocating members up and down, are provided separately to the driving means that operates based on a pressing operation of the pressing apparatus.

4. A manufacturing apparatus for heat exchanger fins according to claim 2, wherein up-down movement means, which move the feed pins of the respective reciprocating members up and down, are provided separately to the driving means that operates based on a pressing operation of the pressing apparatus.

* * * * *